United States Patent [19]

Damm et al.

[11] Patent Number: 5,020,582

[45] Date of Patent: Jun. 4, 1991

[54] METHOD AND APPARATUS FOR COMPACTING FOUNDRY MOLDING MATERIAL IN A FOUNDRY MOLD

[75] Inventors: Norbert Damm, Karlsdorf-Neuthard; Thomas Parr, Karlsruhe, both of Fed. Rep. of Germany

[73] Assignee: BMD Badische Maschinenfabrik Durlach GmbH, Karlsruhe, Fed. Rep. of Germany

[21] Appl. No.: 426,588

[22] Filed: Oct. 24, 1989

[30] Foreign Application Priority Data

Oct. 29, 1988 [DE] Fed. Rep. of Germany ..... 3836876

[51] Int. Cl.[5] ..... B22C 15/00

[52] U.S. Cl. ..... 164/37; 164/169

[58] Field of Search ..... 164/37, 38, 456, 154, 164/195

[56] References Cited

U.S. PATENT DOCUMENTS

| | | | |
|---|---|---|---|
| Re. 32,622 | 3/1988 | Landolt | 164/37 |
| 3,916,976 | 11/1975 | Miller et al. | 164/37 |
| 4,529,026 | 7/1985 | Köbel | 164/37 |
| 4,546,810 | 10/1985 | Landolt | 164/37 |
| 4,592,406 | 6/1986 | Damm | 164/169 |
| 4,598,756 | 7/1986 | Fuchigami et al. | 164/37 |
| 4,619,307 | 10/1986 | Müller et al. | 164/37 |
| 4,750,540 | 6/1988 | Boenisch | 164/37 |
| 4,828,007 | 5/1989 | Fischer et al. | 164/37 |
| 4,846,253 | 7/1989 | Damm | 164/37 |

FOREIGN PATENT DOCUMENTS

| | | | |
|---|---|---|---|
| 3317196 | of 0000 | Fed. Rep. of Germany . | |
| 2403199 | 8/1974 | Fed. Rep. of Germany . | |
| 2933869 | 11/1980 | Fed. Rep. of Germany . | |
| 3740775 | 7/1988 | Fed. Rep. of Germany . | |
| 3511283 | 10/1988 | Fed. Rep. of Germany . | |
| 2198980 | 6/1988 | United Kingdom | 164/169 |

*Primary Examiner*—Richard K. Seidel
*Assistant Examiner*—Rex E. Pelto
*Attorney, Agent, or Firm*—Frishauf, Holtz, Goodman & Woodward

[57] ABSTRACT

To improve the accuracy of making a casting pattern from a casting model or mold (2, 2') in a molding material (M) retained in a foundry form, a single pressure pulse (P) is applied to the molding material which, however, has two phases of pressure gradient, namely a first or initial phase (1) of low pressure gradient extending up to about 1 to 3 bar during between about 10–100 m/sec, for example about 50 m/sec, to initiate fluidization of the molding material. The then fluidized and still fluidized molding material is compacted by raising the pressure from the initial low pressure pulse abruptly at a second and much higher pressure gradient to the customary compaction pressure of between 3 to 6 bar. The two-phase pressure pulse can be applied, selectively, only in a region above the model or throughout the entire mold. The pressure pulse can be generated by applying the pulse but controlling a gas admission valve (11) for an initial slow valve-opening movement, for example by throttling hydraulic counterpressure (35, 36), and then permitting rapid opening movement of the valve (11) by inhibiting the throttling; or (FIG. 4) by applying the full pressure pulse from the valve and interposing a throttle (41) in the path of the air flow from a compressed air chamber (5) to the mold box (3, 4), for example by a relatively shiftable apertured plate operable above a similarly apertured counter plate for selective alignment and misalignment of the respective apertures.

17 Claims, 6 Drawing Sheets

METHOD AND APPARATUS FOR COMPACTING FOUNDRY MOLDING MATERIAL IN A FOUNDRY MOLD

REFERENCE TO RELATED PATENT, THE DISCLOSURE OF WHICH IS HEREBY INCORPORATED BY REFERENCE

U.S. Pat. No. 4,592,406, Damm.

REFERENCE TO RELATED APPLICATION

U.S. Ser. No. 07/146,270, filed Jan. 20, 1988, Damm, which is a Continuation of Ser. No. 06/857,090, filed Apr. 29, 1986, Damm, now U.S. Pat. No. 4,846,253, July 11, 1989, also published as German DE-OS 35 18 980 on Nov. 21, 1986.

REFERENCE TO RELATED DISCLOSURE

German Patent Disclosure Document DE-OS 37 40 776, Fischer.

FIELD OF THE INVENTION

The present invention relates to making foundry molds from models which are retained in a mold form or flask, and more particularly to a method and apparatus to compact molding material, for example molding sand, by applying gas pressure to a surface of the molding material.

BACKGROUND

It is known to apply pressure pulses to molding material, for example molding sand, in a mold form in which a model or pattern of the casting to be made has been placed. This air pulse method is suitable, basically, for foundry work. If the model is complex and has shapes which are difficult to reproduce in the molding sand, homogeneous compaction is necessary. The compaction must be tight so that a hard replica of the model is obtained, even if the model is subject to abrupt differences in dimensions, typically levels, or has contours which differ only slightly from the edge of the model.

U.S. Pat. No. 4,592,406, Damm, assigned to the assignee of the present application, describes an arrangement in which a gas pervious layer is located above the surface of the molding material The gas permeability of this layer is less in the region above the model or pattern than in the region adjacent the edges thereof, that is, the regions approaching the molding form or flask, and where the model is no longer located. This arrangement provides for a substantially improved matching of the hardness of the form to be obtained to the shape of the model.

German Patent Disclosure Document DE OS 37 40 775, Fischer, describes a process in which compaction is carried out by a plurality of sequential pressure pulses, in which the pressure gradient of the first pressure pulse is less than the pressure gradient of the second or subsequent pressure pulse. This dual pressure pulse increases the repetition time or cadence of a foundry form making machine.

THE INVENTION

It is an object to provide a method and apparatus to compact foundry molding material which has excellent matching of the molding material to the model, compacts the molding material tightly also in critical regions of the model, and has a high repetition rate of production.

Briefly, only a single pressure pulse is used which, however, is not uniform with respect to its pressure gradient. The pressure pulse is so controlled that, first the pressure rise with a low rising pressure gradient, the molding material is effectively fluidized. When it is in such fluid state, the pressure is then increased rapidly, that is, a second phase of the pressure pulse follows the first, with a high pressure gradient.

Investigations by the inventors have found that a pressure pulse which varies in pressure gradient provides for substantially improved compaction than one or more pressure pulses which were known before. It appears that the explanation for this improved behavior is that in a first phase, which has a relatively flat curve or low pressure gradient, the molding material is essentially only fluidized, and not really compacted. This fluidization substantially increases the flowability of the molding material without, however, compacting it effectively. Yet, it can flow around ridges and edge portions of the model to match the model precisely. With the material still fluidized, the pressure is then increased rapidly so that, as the pressure rises to the level customary with pneumatic pressure compaction, the then still fluidized molding material is compacted. Increase in pressure merges smoothly with the initial low pressure at a low pressure gradient. The increase of pressure also is readily obtained and the fluidization of the material when the pressure increase results permits rapid operation and a high pressure gradient. Thus, within the same pressure pulse, a first low pressure . gradient phase is followed by a second high pressure gradient phase without, however, release of pressure between the respective phases so that only a single pressure pulse of non-uniform pressure-time relation is used.

It has been found that the compaction characteristics, particularly in narrow regions between single models which may be placed in a mold form, or in narrow regions between the model and the mold form, is substantially improved. The cadence or repetion rate of operation is the same when only a single and high pressure gradient pulse is used; the single pressure pulse in accordance with the present invention, however, has two phases of different pressure gradient.

Preferably, the first phase of the pressure curve rises from zero (0) gauge atmospheric pressure to an intermediate value of about 1 to 3 bar above atmospheric, to then rise smoothly from the intermediate value to a final pressure value which, as is customary, is between about 4 to 6 bar.

Various apparatus units and devices may be used to obtain a pressure rise with the desired different pressure gradients during the pressure pulse. Various types of control mechanisms may be used. In accordance with a preferred feature of the invention, the first phase, with the low pressure gradient, is generated by artificially throttling transfer of compressed air from a compressed air chamber or reservoir to the mold form and, when the second phase with the higher pressure gradient is to start, to cancel or eliminate the throttling. This method and system has the advantage that well known valve constructions, used and found to be highly reliable, can continue to be used; it is only necessary to somewhat delay the opening movement of the known valve construction. This results, automatically, in a first low gradient of pressure rise and, only when the valve opens further and without delay, the well known high gradient pressure phase will follow.

In accordance with a particularly preferred feature of the invention, the pressure pulse with the two different gradient phases is generated only in the region above the mold form where the model or pattern is located; in the edge regions, where there is only mold material, the customary single pressure pulse with a steep pressure gradient is used; thus, in the edge regions, there will be no initial throttling.

By subdividing the space of the mold form, movement of the molding material above the model or pattern is delayed. Thus, the molding material will reach the final compaction above the model at the same time as in those regions where the model is not located. An ideally homogeneous compaction of the entire molding material is thus obtained.

In accordance with a feature of the invention, various systems and devices may be used to obtain this differential application of pressure over the mold form. In the simplest way, a customary mold forming machine equipped for pneumatic pressure pulses is used, in which operation of the valve between a compressed air or other pressurized gas chamber and the mold form is controlled by a hydraulic or pneumatic pressure fluid. To delay the desired opening movement of this valve, it is only necessary to introduce a controllable throttling valve in a pressure supply line which controls the fluid for the control valve.

Molding machines which, for example as described in the referenced U.S. Pat. No. 4,592,406, Damm, assigned to the assignee of the present application, use a gas pervious layer with reduced gas permeability in the region of high contours of the model, can also be used and, with such a machine it is desirable to form this layer above the model as a mechanical throttling element, which has controllable gas permeability or gas passage characteristics. Thus, already at the beginning of the pressure pulses, the gas passage characteristic is decreased and the pressure gradient, thus, will be decreased.

The passage cross section of the throttle element may be from about 0% to 50% of the overall gas passage capability. In accordance with a preferred feature of the invention, it should be controllable to extend to about 30% of the free cross section of the throttle element. The opening time of the throttle element can be controlled, so that it can be matched to the contour of the molding model. The throttle element can open, at least in part, during the opening movement of the pressure chamber valve.

The throttle element, in accordance with a feature of the invention which results in a particularly simple structure, can be formed by relatively slidable apertured plates. In one position, the apertures of the relative slidable plates are covered by the adjacent plate, and in another position they are in alignment, with intermediate positions being possible.

It is not necessary that the throttling element extend over the entire cross section of the molding space or molding form. In accordance with a feature of the invention, and recommended particularly for complex models, the throttling range can be located only in the region above the model or pattern itself. The remaining regions can be free of throttling. These, normally, are the edge regions of the mold forms. If the mold forms are large, for example to mold bathtubs, the relationship will be reversed since the edge regions are the ones where complex shapes are expected, whereas the center is essentially smooth.

Zones of different gas passage characteristics or gas permeability can be defined also in a vertical direction. If this is required, for example due to the shape of the model, the throttling element may contain baffle or bulk head walls, extending or dipping downwardly into the molding material, for example the molding sand. These baffles extend through the filler frame and may extend even into the mold box or flask itself.

The method can be carried out with two valves, in which one valve controls the inner region above the model or pattern, and the other valve controls the edge region of the mold form, that is, free from model or pattern. This arrangement permits individual matching of the pressure gradients of the single pulse to the respective regions of the mold form in dependence on the size, condition and shape of the model or pattern. Baffle plates extending into the molding material permit limiting mutual influence of pressure relationships only towards the end or terminal portion of the single pressure pulse.

If the mold forms are large, more than two valves may be used, particularly if it is necessary or desirable to subdivide the inner region of the molding form space into a plurality of sub-regions or sub-zones. The baffle plates assist in leaving the respective pressure gradients associated only with the respectively desired regions of the model.

DRAWINGS

Figure 2:
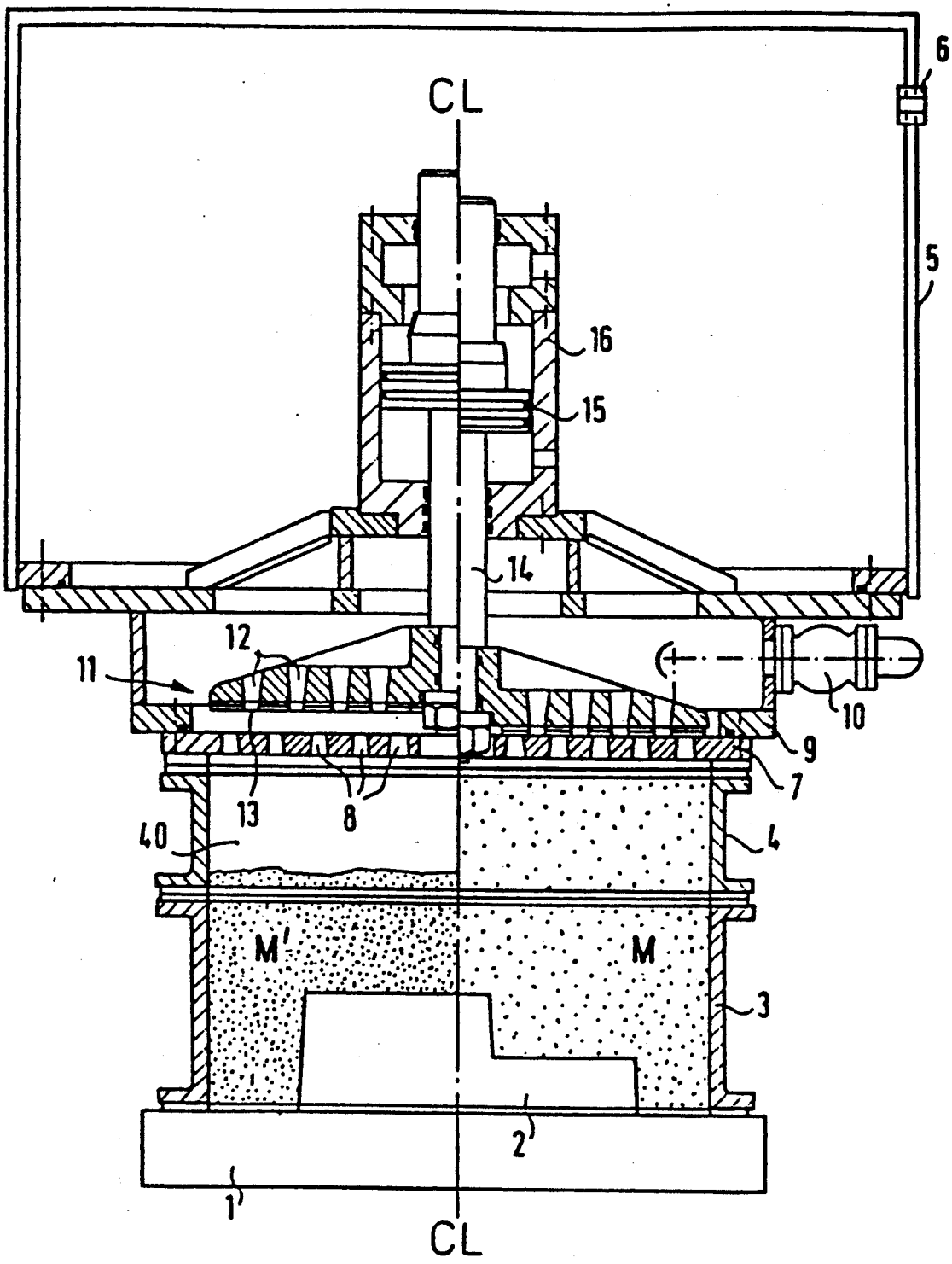
FIG. 2 is a highly schematic vertical cross-sectional view through a molding machine in accordance with the present invention, omitting all parts not necessary for an understanding of the present invention, and in which the left and right portions of the machine, with respect to a center line, although identical, are shown in different operating positions.
Figure 5:
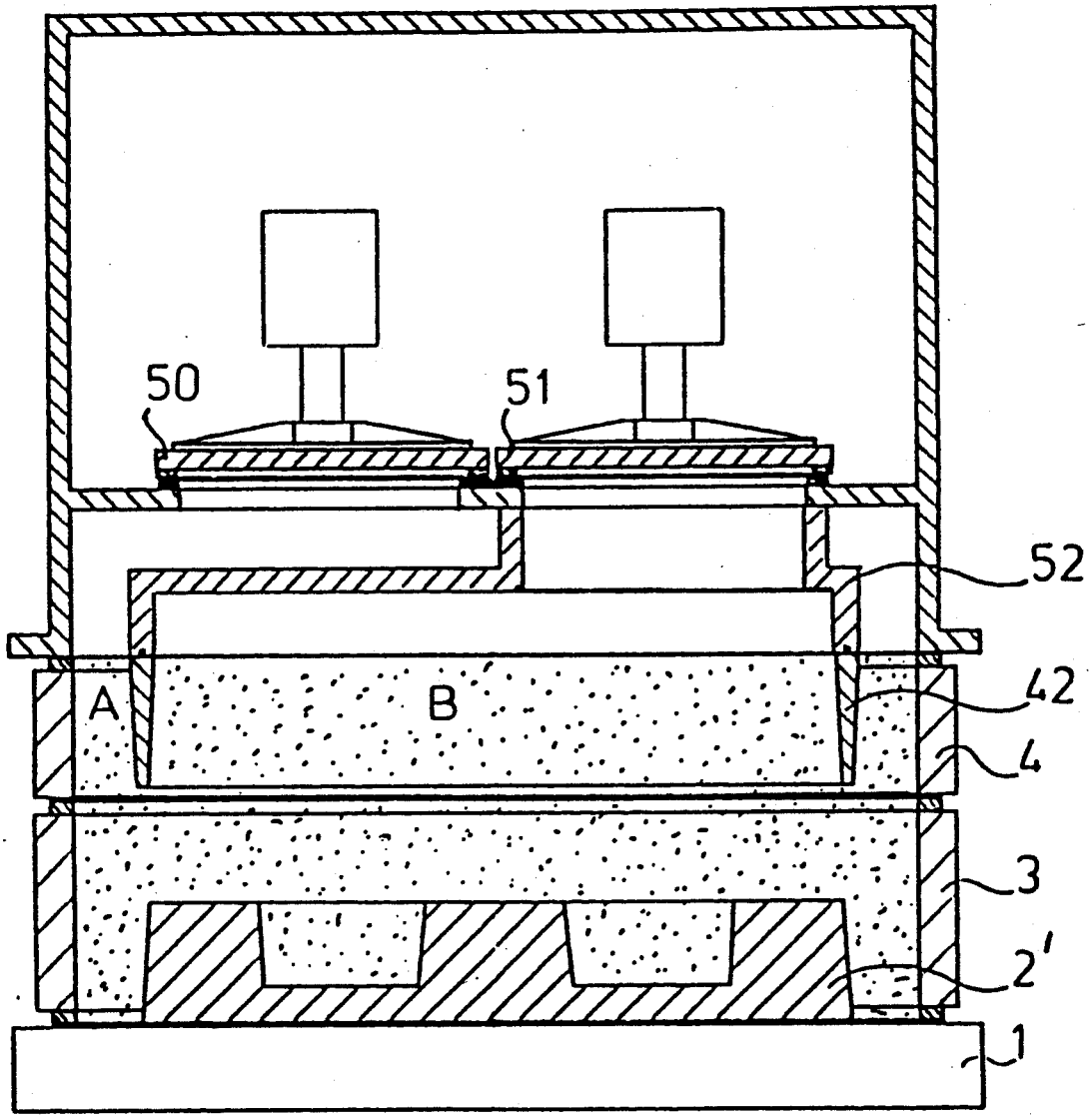
FIG. 5 is a mold making machine similar to that of FIG. 2, with two compressed pressure fluid valves.
Figure 5A:
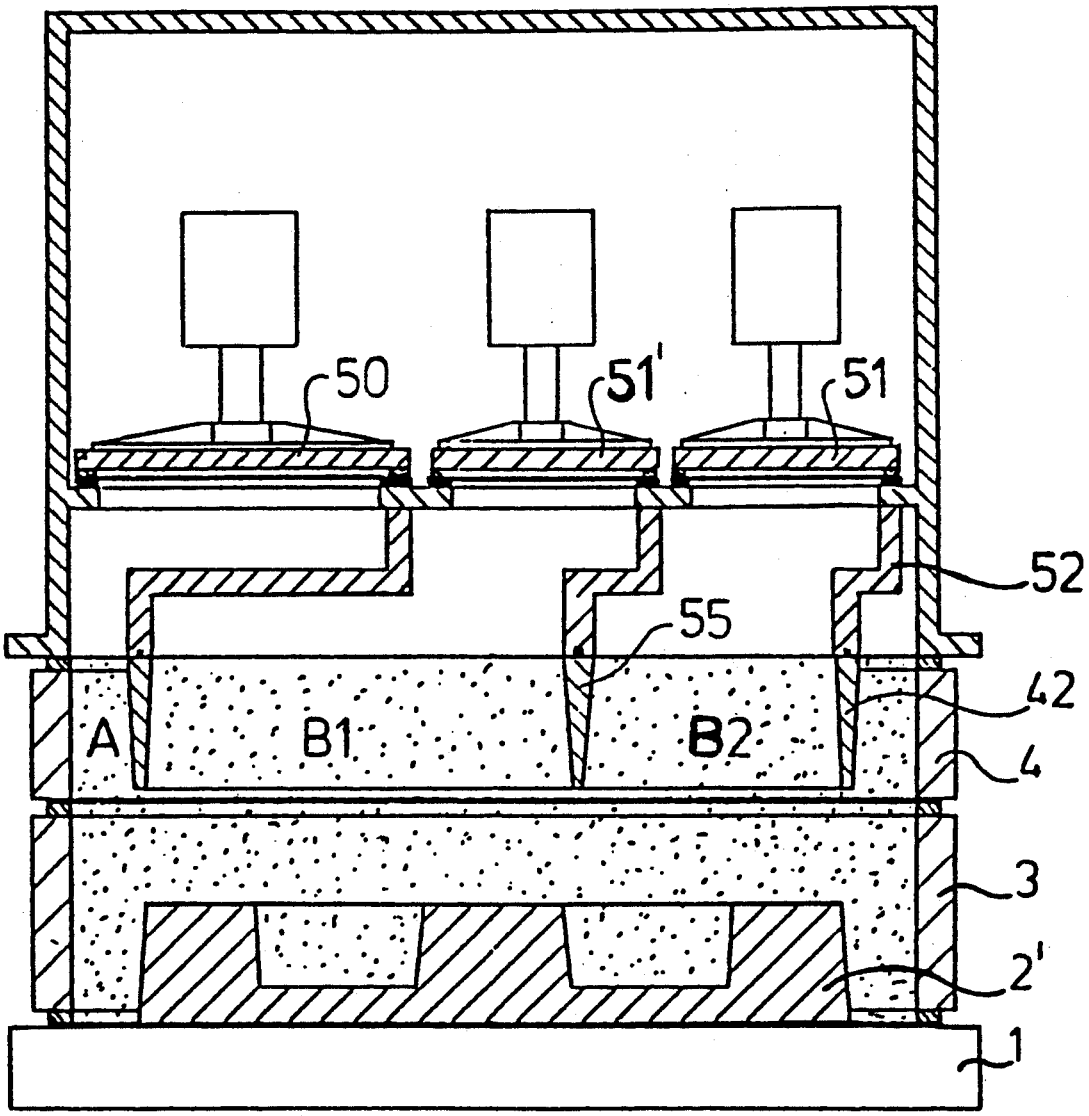

FIG. 5*a* is a mold making machine similar to that of FIG. 2, with three compressed pressure fluid valves.

DETAILED DESCRIPTION

Figure 1:
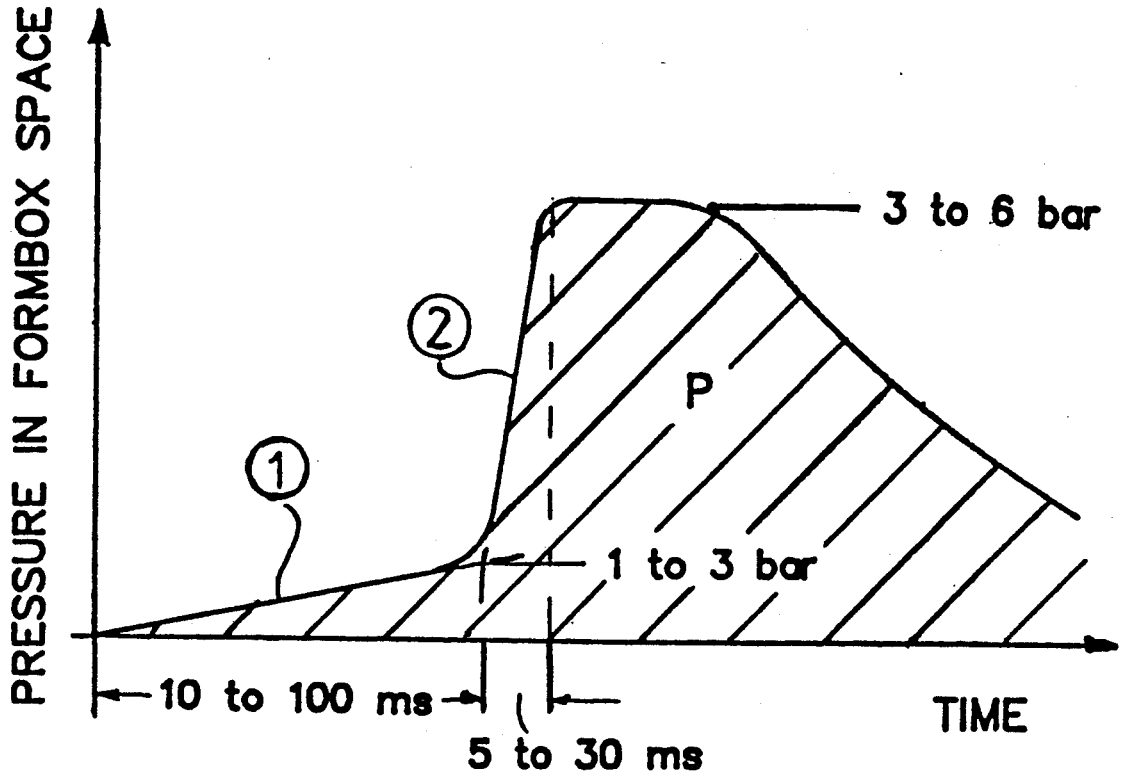
FIG. 1 is a pressure-time diagram of a single pressure pulse in which the ordinate represents pressure in the molding space, and the abscissa represents time.

In accordance with the present invention, a single pressure pulse is supplied which, with respect to time, has approximately the shape shown in FIG. 1. First, an unusually low pressure gradient of about 30 to 100 bar/-sec is applied until a pressure of from 1 to 3 bar is reached. This first phase 1 of the pressure pulse P merges smoothly with the second phase 2 of the pressure pulse P, in which, by pulse compaction, the customary pressure gradient of from about 100 to 600 bar/-sec is used. Pressure equalization between the pressure chamber and the mold form space, as before and as is customary, of between about 3 to 6 bar will then result. The pressure will then decrease, by venting the pressure medium through gaps in the mold form and/or through openings formed in the mold form. The pressure gas can also be removed by suction, for example in a closed cycle, which is particularly desirable if the pressure gas is or includes a reaction gas which contributes to chemical hardening or curing of the mold making material.

The first phase 1 of the pressure pulse P, in advance of the customary high gradient phase 2 results in intensive fluidization of the molding material introduced into the mold box or flask. This improved flowability of the molding material is decisive for compaction during the second phase 2 of the pressure pulse. Since the second phase 2 of the pressure pulse follows directly and merges smoothly with the first phase and before air can leave the form box after the first phase of the pulse, compaction of the material is enhanced since it starts from already fluidized material which, because of the fluidized state, can accurately reproduce all contours of the model. This is in stark contrast to a known method in which sequential pressure pulses are used, and in which the pressure applied during the first pulse has effectively dissipated already due to venting when the second pressure pulse starts.

The particular course, with respect to time, of the pressure pulse in accordance with the present invention thus is suitable for models or forms with deep depressions, for example of essentially spherical or part-spherical shape.

In accordance with a feature of the present invention, a known molding apparatus and system can be used, modified only to obtain the particular shape of the pressure pulse P, shown in FIG. 1. Reference is made to U.S. application Ser. No. 07/146,270, filed Jan. 20, 1988, which is a Continuation of Ser. No. 06/857,090, filed Apr. 29, 1986, Damm, now U.S. Pat. No. 4,846,253, published as German DE-OS 35 18 980. The basic system is shown in FIG. 2 in which only those elements necessary for an understanding of the improvement of the present invention are described in detail.

A base plate 1 for a pattern or model 2 supports a mold box 3. A filling frame 4 is seated on a mold box 3. A pressure container 5, forming a pressure chamber, is located above the mold form space formed by the mold form 3 and the fill frame 4. Chamber 5, in the embodiment of the invention shown, is arranged to receive compressed air through a coupling 6 from a pressure source, for example a compressed air supply provided for the foundry plant.

The pressure chamber 5 terminates at the bottom in a plate 7 which has a plurality of openings 8 therein. The upper side of the bottom plate 7 has a frame 9 flange-connected thereto, for example by screws, to which a vent line, with an interposed valve 10, is connected.

The pressure chamber 5 with the frame 9 on the one hand, and the model plate 1 with the model 2, form box 3 and fill space 4 on the other, are movable with respect to each other in order to permit filling the mold form space, until just below the bottom 7, with molding material M. The two groups of the system are joined together before compaction and are then tightly clamped together at their prior separating surface. Plate 1 and/or box 3 may have vent openings.

A closing element, in form of a rigid valve plate 11, is operatively associated with the bottom plate 7, or, rather, with its openings 8. The valve plate 11 has a plurality of openings 12 extending therethrough. A sealing layer 13 is located at the bottom side of the valve plate 11, at least in the region of the openings 12. The openings 8 in the bottom 7 of the chamber 5 and the openings 12 in the valve plate 11 are offset with respect to each other so that, when in closed position shown at the right side of FIG. 2, that is, right of the center line CL, the openings 12 in valve plate 11 block the openings 8 in the bottom 7. The valve plate 8 is coupled to a guide rod 14 which, simultaneously, forms the piston rod of a piston 15 slidable within a pressure fluid cylinder 16.

Figure 3:
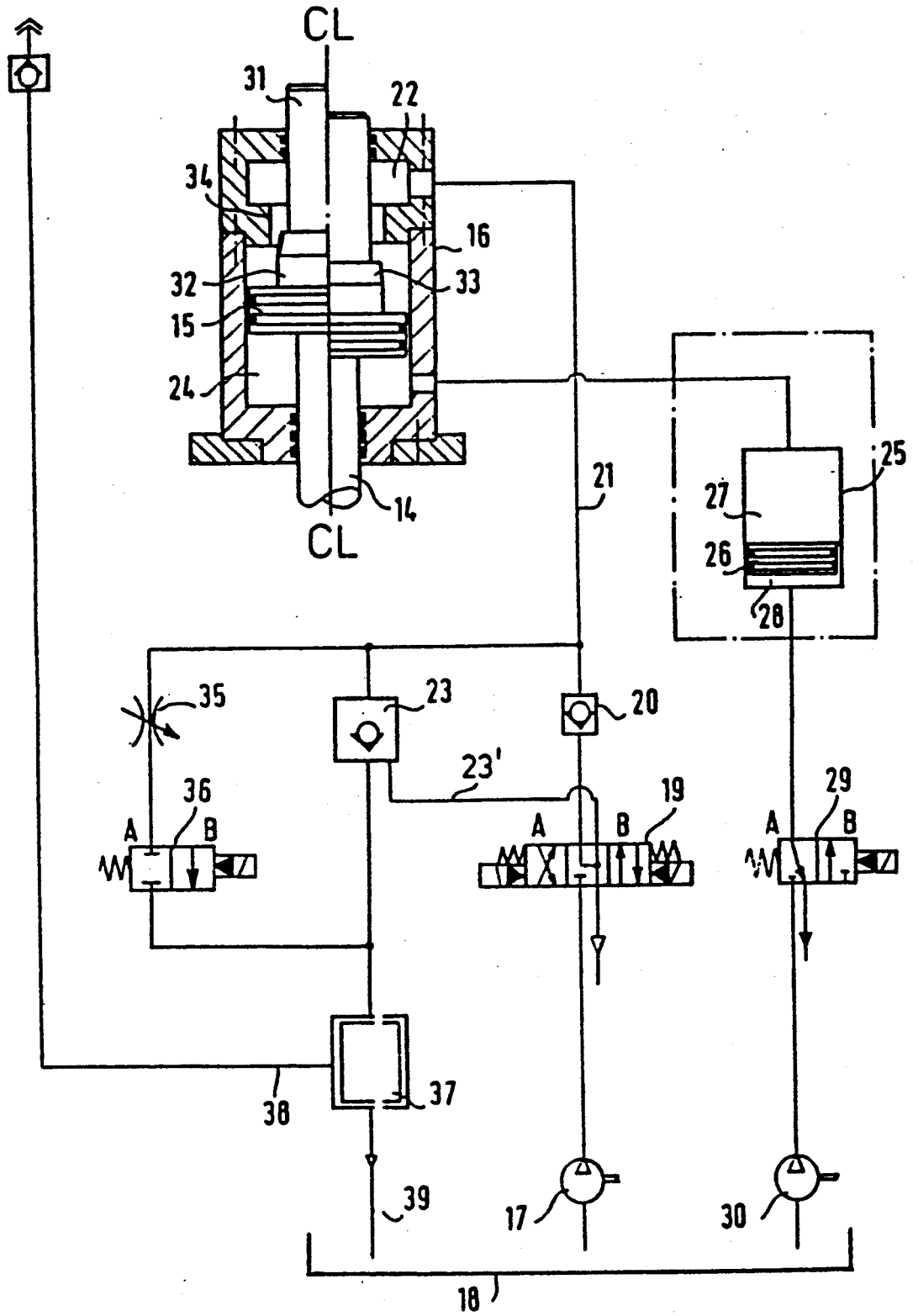
FIG. 3 is a control diagram for the apparatus of FIG. 2, in which the control valve is shown in detail, again subdivided with respect to its center line to show different operating positions.

Referring now to FIG. 3, which shows control of the piston 15 within the cylinder 16, to lift the valve plate 11: The pressure fluid cylinder 16 is coupled to a hydraulic loop. A pressure source 17, for example a hydraulic pump, receives pressure fluid from the tank 18. The pressure fluid from pump 17 is conducted over control spool valve 19 through a check valve 20 to a supply line 21, which connects the pressurized fluid into a pressure chamber or pressure space 22 of the cylinder 16. This is a hydraulic pressure connection, and the pressure fluid is, for example, a suitable hydraulic pressure oil.

The space beneath piston 15 forms a gas pressure chamber 24, which is coupled to a gas pressure supply storage element 25. The gas store 25 is separated into a gas chamber 27 and the hydraulic pressure chamber 28 by a slide piston. The hydraulic chamber 28 is coupled through a spool valve 29 to a hydraulic pressure source, for example a pump 30 which, in turn, receives hydraulic pressure fluid from the hydraulic supply or sump 18.

The piston rod 14 of the piston 15 in the pressure fluid cylinder 16 is extended by an extension rod 31 passing through the hydraulic pressure chamber 22. The upper piston rod 31, immediately adjacent the piston 15, is formed with or carries a cylindrical extension 31 which terminates in a conically decreasing end portion 32. The end portion 32, upon upward movement of the piston 15, forms a chocke with a cylindrical inwardly extending flange or ring 34, projecting inwardly in an upper portion of the cylinder 16.

The hydraulic supply line 21 is connected to a controllable check valve 23. Control of the check valve 23 is obtained through a hydraulic connection line 23', coupled to the spool valve 19. The pressure space 22, when the check valve is in non-checked, that is, in open position, is coupled to a drain line 39, passing through a drain tank 37 with a vent connection 38 and terminating in the hydraulic fluid supply tank or sump 18.

The system, so far generally described, is similar to that shown in FIG. 2 of the referenced application Ser. No. 07/146,270, filed Jan. 20, 1988, now U.S. Pat. No. 4,846,253, by the inventor hereof.

In accordance with the present invention, the hydraulic connection line 21 to the hydraulic pressure chamber or space 22 is additionally connected to a controllable choke or throttle 35 which is serially valve 36 are connected in parallel to the check valve 23, and permit slow drainage of the pressure fluid from the chamber 22.

BASIC OPERATION

SYSTEM OF FIG. 3

FIG. 2 illustrates the position of the plate 11 in lifted condition, that is, permitting compressed air from chamber 5 to compact the molding medium, as shown schematically at M'. To return the valve plate 11 from the position shown at the left side of the center line CL to the closed position shown at the right side of FIG. 2, the control slider 19 is placed, for example by an external electrical control signal, or manually, into the switching position B. In this control position, the pressure source 17 is connected to the chamber 22 of the cylinder 16. The check valve 20 will be open. At the same time, the control line 23', connected from the spool valve 19 to the controlled check valve 23, is depressurized, so that check valve 23 will close. Pressure fluid thus fills the hydraulic space 22, and the valve plate 11 is moved downwardly, to the position shown at the right half of FIG. 1, under hydraulic pressure. The sealing layer 13 will seal the valve in closed position. Valve 36 is in position A.

At that instant of time, the control slider 29 will the be in position A. The gas pressure space 24 of the cylinder 16 is connected to the gas storage element 25 and receives a low pressure pre-charge of, for example, 30 to 40 bar. The volumetric ratio of the gas pressure chambers 24 in cylinder 16 and 27 in the store 25 is about 1 : 10 to 1 : 15. The closing stroke of the plate 11 thus slightly compresses the pre-charge of the gas in the spaces 24 and 27.

After the pressure plate 11 is closed, the model carrier 1 with the mold box and filler space 4 is clamped in the frame 9. The gas pressure chamber 5 is filled with compressed gas, for example compressed air, via the pressure connection 6.

The valve 10 is closed. After the mold form holder 1, 3, 4 and frame 9 are securely coupled together, control slider 29 is shifted to the position B. This connects the pressure chamber 28 of the gas pressure supply 25 to the high pressure source 30. The gas pressure spaces 27 and 24 are compressed to an operating pressure of between about 200 to 250 bar. The valve plate 11 is blocked, i.e. in closed position to the fluid pressure in the pressure chamber 22, although it is already pre-stressed.

In order to apply a pressure pulse from the chamber 5 for compaction of the medium M, still uncompacted as seen on the right side of the center line CL in FIG. 2, it is necessary to move the valve plate 11 into open direction, as shown at the left half of FIG. 2. For raising the valve plate and applying the gas pressure pulse, the control slider 19 is switched to the position A. Upon switch-over, fluid pressure from the source 17 is applied through control line 23' to the check valve 23, so that the check valve 23 will open and, due to relatively large cross-sectional areas of the supply line 21 and the drainage line through check valve 23, pressurized fluid can escape from the chamber 22 under action of the compressed air in the compressed gas store 25. Pressurized fluid will pass into the chamber or tank 37. When the piston 15 is moved upwardly, the cross-sectional space between the piston rod 31 and the narrowing rim 34 is changed, to provide for a gentle stop. During the opening movement, the pressure medium which is being displaced may drain from the chamber 22 with a speed of more than 10 meters per second, and preferably between about 20 to 30 meters per second. The reception or drainage tank 37 is vented between operating strokes or repeat cadences via the vent line 38, so that its content can drain to the supply tank or sump 18.

After the compaction, the valve plate 11 is brought into closed condition and the pressure region 40 which will result above the compressed molding medium M' can be vented through valve 10. The mold form can then be separated, and the pattern or model 2 removed and the compacted casting medium M' in its form box 3 transported for casting.

Operation in accordance with the present invention

The above-described, basic operating system is modified, in accordance with the present invention, by the presence of the controllable throttle 35 and the valve 36, connected in parallel to the controlled check valve 23 and in the connection line 21 to the drain tank 37.

The throttle 35, initially, permits only a small return flow from the pressure chamber 22. At the start of pulse P, only valve 36 is controlled to open condition, so that the lifting pressure applied by gas from the store 25 will not act against an open line 21, as before, but rather act against a line which permits some drainage through the throttle 35 and the then opened valve 36. After some time, for example between 10 to 100 milliseconds and, preferably, about 50 milliseconds, valve 19 will control the check valve 23 to open so that full drainage, as explained above, is obtained, and pressurized fluid can flow directly from the chamber 22 into the drainage tank 37. Valve 11 will then rapidly move upwardly, as is described above, to the maximum open position, to generate the phase 2 of the pressure pulse P.

The present invention, thus, can be easily adapted to existing systems by merely adding the throttle 35 and valve 36, and controlling valve 36 to open for the duration that the phase 1 of the pressure pulse P as desired, for example about 50 milliseconds, in advance of the control of check valve 23 through line 23'. In new installations, the function of the throttle 35, valve 36 and check valve 23 can be combined in a single unit, for example a proportioning valve which has the characteristic of opening for a limited extent in a first phase and completely in a second phase.

Figure 4:
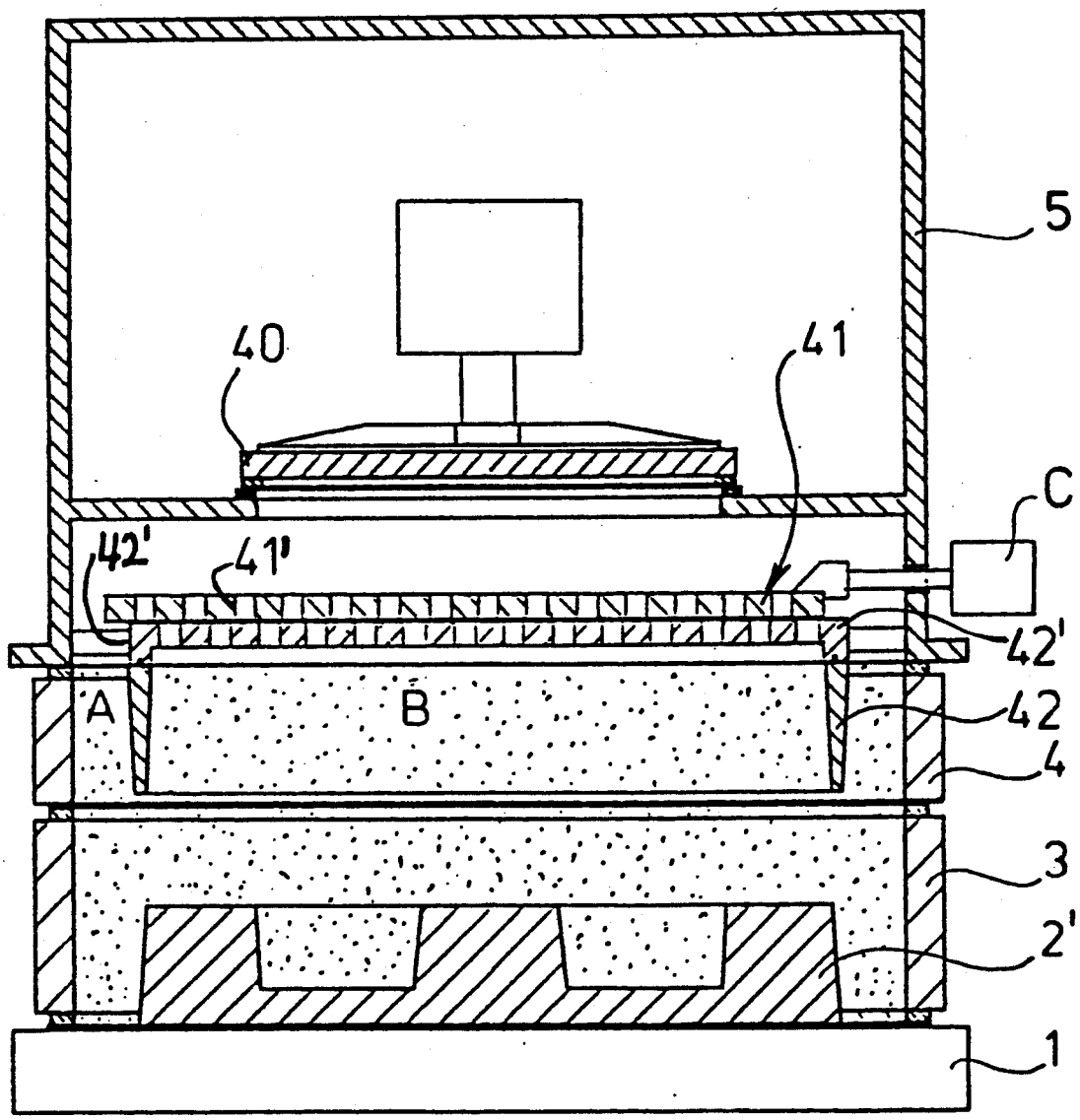
FIG. 4 is a fragmentary vertical sectional view through a mold making machine having a different valve structure.

The course of pressure-time relation of the pulse P can be obtained by other structures and arrangements than those described above, and which are particularly suitable for modification of installations and systems similar to those of the referenced application Ser. No. 07/146,270, now U.S. Pat. No. 4,846,253, by the inventor hereof. FIG. 4 illustrates, schematically, a molding machine in which all parts similar to those described have been given the same reference numerals, and will not be described again.

The model 2' is retained, as before, in a mold box 3, coupled to a fill frame 4 and located on a base plate 1. A valve 40 closes off a compressed air chamber 5 with respect to the upper regions of the molding material.

Valve 40 is shown only schematically. Valve 40 may, for example, be similar to the valve construction shown in FIG. 2, that is, the combination of an apertured plate 7 with a raisable apertured element 11, lifted under influence or under control of pneumatic and/or hydraulic pressure. Other valve constructions may be used. It is only necessary that the valve 40 be coupled to a rapid-acting reliable lifting system, in order to provide a pressure gradient above the molding material in the order of from about 100 to 600 bar/sec The valve 40 need not open in two phases, or delays, as described in connection with FIGS. 2 and 3. The delayed high pressure gradient of phase 2 and the low pressure gradient of phase 1 during the pressure pulse is obtained differently and is applied to that region of the molding material which is above the mold form or pattern 2'.

A throttling element 41 is located at the upper side of the molding material, and positioned beneath valve 40. The throttle element is formed by two apertured plates 41', 42', in which the apertures are located in a grid or other suitable pattern. The plates 41', 42' are located horizontally and can be horizontally shifted with respect to each other, for example rotated or slid longitudinally, to bring the apertures in the respective plates 42', 41' into alignment or out of alignment and in blocking position. The openings are so located that, in one position, they are entirely or almost entirely closed whereas, in another position, they are completely open and in alignment. Such slide valve elements, as well as their operation by a suitable operating control C, are well known structural elements in the foundry machinery field and any suitable and known construction may be used.

In accordance with a feature of the invention, the throttle plate 42' of the throttle arrangement 41 is formed with downwardly extending baffles or bulk head plates 42, forming a pressure gas direction system. The baffle plates 42 dip into the molding material M. Preferably, they extend close to the bottom of the fill frame 4 and may extend even into the mold box 3. The baffle plates 42 are so positioned that they roughly align with the outer contour of the model 1.

Operation

Initially, the throttle 41 is closed or almost closed. Upon opening of the valve 40, a pressure pulse can propagate without blocking only at the edge regions A of the mold form space. The inner region B which is beneath the throttle 41 will receive only a weakened or impeded pressure pulse, the pressure gradient of which corresponds approximately to the phase 1 of the pressure curve of FIG. 1. After about 50 milliseconds, the throttle 41 is moved by the control element C into its fully opened position, and pressure will rise rapidly with the pressure gradient of the phase 2 as shown in FIG. 1.

The construction of FIG. 4 thus permits application of a pressure pulse which has the pressure-time relationship as shown in FIG. 1 only in the region B above the pattern or model 2'; the region which does not contain any models, at the corners or edges or marginal regions of the mold box 3, are pressurized immediately by the pressure pulse to its full extent and having an initially steep pressure gradient curve.

Existing molding machines can readily be adapted to incorporate the present invention; retrofitting such molding machines is simple; it is only necessary to include the throttling element 41 by adding the plates 41', 42' and the control C in a thin unit which can be flange-connected to the chamber 5 and the fill frame 4.

Some models are very difficult to mold due to their shapes; in such arrangements, it may be desirable to provide for individual pressurization of various regions of the molding space. FIG. 5 illustrates an example in which the marginal regions A and the inner region B are controlled by individual respective valves 50, 51. Both valves can be controlled individually, or separately, and open, in timed relation with respect to each other and with individual timing, as desired, and with variable pressures if desired. They can be coupled to the same pressure chamber, or to different or individually separated pressure chambers.

Baffle walls 52 separate the two regions of the mold form space, which also separate the end regions of the valves 50, 51 to provide for individual application of pressure pulses to individual regions. Above the model 2', therefore, the pressure relationship can be controlled in accordance with the pulse-time diagram of FIG. 1, whereas in the marginal region A the pressure pulse may, initially, have a steep gradient. The baffle plates 42 are upwardly extended by extension elements 52 so that they will receive the pulse as shown in FIG. 1.

It is, of course, also equally possible to individually and entirely separately and independently compact the molding material in the region B and in the region A.

The pressure gas may be compressed air, or may be a chemical gas or have chemical additives which react with chemicals within the molding material for hardening or curing molding material.

FIG. 5 also illustrates that, optionally—as shown in FIG. 5*a* —the system may have more than two valves, in which, for example, the gas supply which controls fluidization and compaction of the molding material M above the model is subdivided into subregions B1, B2, for example in accordance with shapes, intricacies and the like of the model. An additional valve 51', then, admits pressure to the region to the left of the baffle 55, whereas the valve 51 admits pressurized fluid to the region to the right of the baffle 55. This gas direction path is not readily visible in a vertical cross section, since it can be placed one behind the other, in planes perpendicular to the plane of the drawing. Of course, each one of the valves 51, 51' is individually controllable, see discussion in connection with FIGS. 2 and 3, or have their own individual throttle plates and control arrangements, as described in detail in connection with FIG. 4, so that the course, time and pressure conditions of the gas pressure pulse being applied to the molding material in the respective regions B, or B1, B2, can be individually controlled, for example in accordance with the intricacies or size of the casting or model pattern 2'.

Various changes and modifications may be made, and any features described herein may be used with any of the others, within the scope of the inventive concept.

We claim:

1. A method of compacting molding material (M) surrounding a casting model (2, 2') retained in a foundry form (1, 2, 3), comprising the steps of first fluidizing the molding material and then compacting the still fluidized molding material by applying a single pressure pulse of pressurized gas thereto, wherein said pulse applies pressures above atmospheric pressure and has sequential phases of different pressure gradients, including a first or initial phase of low, rising pressure gradient for fluidizing the material, and a second or subsequent phase of increasing pressure at a pressure gradient higher than said pressure gradient of said first or initial phase for compacting said previously fluidized material; and wherein the step of first fluidizing the molding material comprises applying said first or initial phase of low pressure gradient until an intermediate pressure value in the order of about 1–3 bar above atmospheric will result, and the step of increasing the pressure at said pressure gradient of the second or subsequent phase comprises raising the pressure from said intermediate pressure value to a final pressure value above said intermediate value.

2. The method of claim 1, wherein said step of generating the pressure pulse with two pressure rise phases comprises generating a pressure pulse with a high pressure gradient and throttling application of said high pressure pulse to said molding material (M) to thereby apply the first or initial phase of said high pressure pulse thereto; and then eliminating or cancelling throttling of said high pressure pulse during said second phase.

3. The method of claim 2, including a valve means separating a pressure pulse space (5) from said molding material (M), wherein said throttling step comprises controlling the valve means to throttle the application of the pressure pulse during said first or initial phase; and wherein the step of eliminating throttling comprises opening said valve means to permit unrestricted application of pressure in said pressurized space to said molding material during said second or subsequent phase of said pressure pulse.

4. The method of claim 1, further including the step of applying said single pressure pulse having said initial and subsequent phases of pressure gradient only over a region of said foundry form (1, 3, 4) in which said casting model (2) is positioned; and applying a pressure pulse having an initial high pressure gradient to the molding material (M) in a region outside of the position of the model and between confining walls (3) of said foundry form.

5. The method of claim 1, wherein said initial phase extends during between about 10 to 100 milliseconds and, optionally, about 50 milliseconds and at the end of said first phase the pressure will have an intermediate value in the order of between 1 to 3 bar; and wherein said subsequent phase of the pressure pulse will have a final pressure of between about 3 to 6 bar, and the higher pressure gradient extends during about 5 to 30 millisecond to reach said final higher pressure level of the subsequent phase of said single pressure pulse (P).

6. Apparatus for compacting molding material (M) surrounding a casting model (2) and retained in a foundry form (1, 3, 4) having a pressurized gas chamber (5) retaining a supply of pressurized gas;

at least one supply valve (40) selectively establishing fluid communication between said chamber (5) and a region above the molding material (M), and comprising, in accordance with the invention, a controllable throttle (41) located above the molding material, said controllable throttle being gas pervious and having a gas passage characteristic which is controllable in accordance with the position of the throttle, said throttle being located in the path of gas from said chamber (5) to said region above the molding material (M);

means (c) controlling said throttle to apply said gas pressure in an initial, throttle phase of low, rising pressure gradient and until an intermediate pressure value above atmospheric will result, for fluidizing of said molding material and, thereafter, controlling said throttle to effectively eliminate throttling action thereof and continue said single pressure pulse at a high pressure gradient to raise the pressure from said intermediate pressure value to a final pressure value above said intermediate value, to cause fluidization of said molding material during the initial phase and then compaction of the still fluidized material during said subsequent phase; and baffle plates (42) projecting downwardly from said throttle and extending at least in part into the molding material, to apply said pressure pulse having said initial and subsequent phases selectively only to selected regions above said model.

7. The apparatus of claim 6, wherein the control means (C) controls the opening of said throttle to provide, during said initial phase, opening passage of between 0% to about 50%, and optionally to about 30% of the maximum flow passage area of said throttle.

8. The apparatus of claim 7, wherein said control means controls the throttling time and time-throttle opening relationship of said throttle.

9. The apparatus of claim 6, wherein said control means (C) controls opening of said throttle at least in part during the time that said at least one supply valve (40) establishes fluid communication between said chamber (5) and the region above the molding material.

10. The apparatus of claim 6, wherein said throttle (41) comprises a pair of apertured plates (41', 42') positioned above each other, and in which the apertures of one plate (41) can be brought, selectively and under control of said control means (C) in alignment, or out of alignment, with the apertures in the other plate (42').

11. The apparatus of claim 6, wherein said throttle (41) is located only in a region (B) above said casting model (2').

12. Apparatus for compacting molding material (M) surrounding a casting model (2) and retained in a foundry form (1, 3, 4) having a pressurized gas chamber (5) retaining a supply of pressurized gas;

at least two supply valves (40), each establishing, selectively, fluid communication between said chamber (5) and a region above the molding material, and wherein one (51) of said at least two supply valves is coupled to apply gas pressure from said pressure pulse to a region (B) which is located above said casting model (2'); and wherein the other (50) of said at least two supply valves is pneumatically coupled to a region (A) outside of the location of said casting model.

13. The apparatus of claim 12, wherein said region (A) outside of the casting model comprises marginal regions of said mold form (1, 3, 4).

14. The apparatus of claim 12, further including gas directing walls or baffles (42, 52) extending from at least one (51) of said at least two supply valves (50, 51), and extending at least in part into said molding material (M) for pneumatically separating said regions (B, A) above, and beyond, said casting model (2').

15. The apparatus of claim 12, further including a controllable throttle (41) interposed in the gas communication path between said supply valve (51) controlling application of pressure to said region (B) above the model (2'), said controllable throttle having a gas passage characteristic which is controllable in accordance with the position of the throttle, said throttle being located in the path of gas from said chamber (5) to said region above the molding material (M).

16. The apparatus of claim 12, wherein additional baffle means (55) are provided, in gas communication with an additional supply valve (51'), said additional baffle means subdividing said region (B) above said model (2') into subregions (B1, B2) to permit individual application of said gas pressure pulse (P) to said individual subregions.

17. The apparatus of claim 16, wherein the pressure-time course, including the pressure gradients and duration of respective pressure gradients of the pulse applied to the respective subregions (B1, B2) are individually controllable to have, each, an individually selected initial phase of low pressure gradient of selected duration and maximum pressure which merges into a subsequent phase of higher pressure gradient of selected gradient and final pressure level, to cause individually controlled fluidization of the molding material above the model in said respective regions during the initial phases of application of pressure and then compaction of the still fluidized material during said subsequent phases.

* * * * *